United States Patent [19]

Hilbert et al.

[11] 4,218,058

[45] Aug. 19, 1980

[54] ADJUSTABLE SYSTEM FOR MOUNTING A BASKETBALL GOAL

[76] Inventors: Robert A. Hilbert, 2616 Reckord Rd., Kingsville, Md. 21087; William F. Kohl, Jr., 620 Lake Dr., Towson, Md. 21204; Joseph M. Whelan, 249 Meadowvale Rd., Lutherville, Md. 21093; John L. Apichella, 48 Glen Alpine Rd., Phoenix, Md. 21131

[21] Appl. No.: 904,196

[22] Filed: May 9, 1978

[51] Int. Cl.[3] ..... A63B 63/08; A63B 63/04

[52] U.S. Cl. ..... 273/1.5 R; 248/243

[58] Field of Search ..... 273/1.5 R, 1.5 A; 248/243, 244, 246

[56] References Cited

U.S. PATENT DOCUMENTS

| | | | |
|---|---|---|---|
| 327,129 | 9/1885 | Bains | 248/243 |
| 1,055,201 | 3/1913 | Mason | 248/243 UX |
| 1,522,957 | 1/1925 | Kennedy | 273/1.5 R |
| 2,534,067 | 12/1950 | Rubin | 273/1.5 R |

*Primary Examiner*—Anton O. Oechsle

*Attorney, Agent, or Firm*—Walter G. Finch

[57] ABSTRACT

The invention is an improved adjustable system for mounting a basketball goal. The adjustable system has two embodiments, one in which no modification is made to the mounting bracket on the basketball goal, and the other with a wide range of positions in which a minor modification is made to the mounting bracket on the basketball goal. The simple means of adjusting the height of the basketball goal is advantageous for schools, clubs, recreation units and other similar organizations that cater to, or have members of, a wide range of age groups and a consequent wide range of individual heights of boys, girls, men, and women. The economics of the simplicity of the device is another major factor.

4 Claims, 5 Drawing Figures

ADJUSTABLE SYSTEM FOR MOUNTING A BASKETBALL GOAL

BACKGROUND AND SUMMARY OF THE INVENTION

The invention relates to mounting systems for basketball goals, and in particular to adjustable mounting systems for such goals, specifically, to an adjustable mounting system that is simple, economical, and covers a wide range of player heights (from small children to tall grown people).

A need has existed for a simple means of adjusting the height of basketball goals to fit the height of the players. This is particularly true in schools, clubs, recreation units and similar organizations that have a membership ranging from small children to the tall players.

Numerous means exist for adjusting the height of basketball goals, but all are cumbersome devices of massive structural fabrication, complicated ropes and pulleys and ceiling or wall mounted devices, and other similar complex structures. Most utilize a movement of the entire back-board structure along with the basketball goal. The present invention involves only the movement of the basketball goal itself in a permanently mounted special holder.

It is, therefore, an object of the invention to provide a system for mounting a basketball goal that is adjustable.

It is a further object of the invention to provide an adjustable system for mounting a basketball system that is economical.

Another object of the invention is to provide a system for mounting a basketball goal that has a wide range of positions.

It is another object of the invention to provide a system for mounting a basketball goal that is simple to operate.

It is still another object of the invention to provide an adjustable system for mounting a basketball goal that moves only the basketball goal and does not require adjusting or moving the height of the entire basketball goal back-board.

It is yet another object of the invention to provide an adjustable system for mounting a basketball goal that does not use ropes, pulleys, cranks and similar mechanisms.

Further objects and advantages of the invention will become more apparent in light of the following description of the preferred embodiments.

DESCRIPTION OF THE PREFERRED EMBODIMENTS

Figure 1:
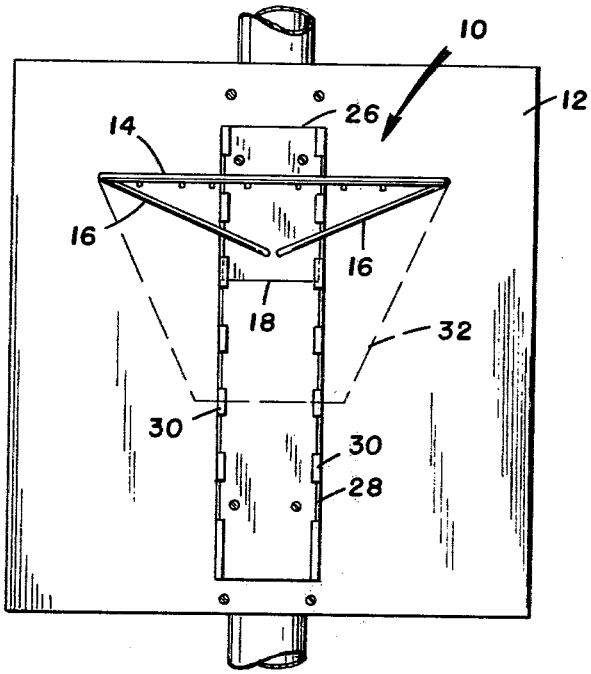
FIG. 1 is a front elevation of one embodiment of the adjustable mounting system with a basketball goal installed.
Figure 4:
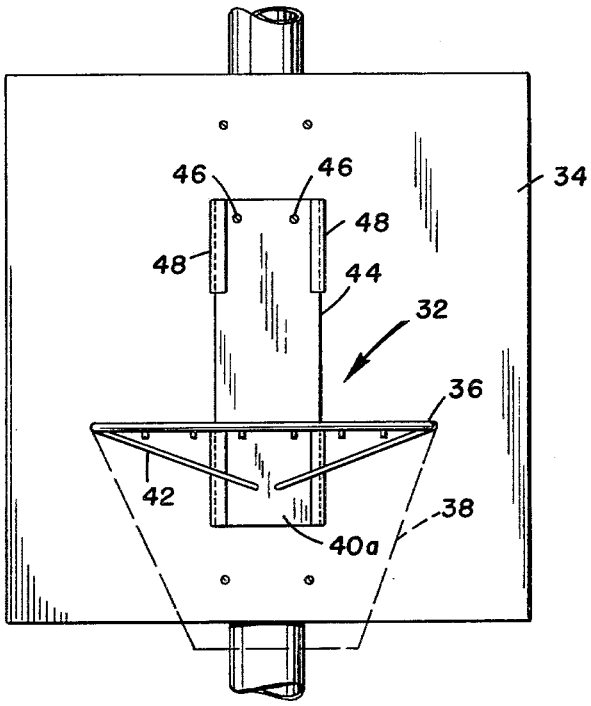
FIG. 4 is a front elevation of a second embodiment of the adjustable mounting system with a basketball goal installed.

Referring now to the drawings and particularly to FIGS. 1 and 4. The first embodiment of the adjustable mounting system for a basketball goal is shown at 10 in FIG. 1. The second embodiment of the adjustable mounting system for a basketball goal is shown at 32 in FIG. 4.

Considering the first embodiment, in FIG. 1, the basketball goal 14 is shown integrally attached to its normal mounting bracket 18, with braces 16 from the hoop of the basketball goal 14 shown attached at both the hoop of the goal 14 and at the normal mounting bracket 18.

The outline of the net 32 of the basketball goal 14 is shown in phantom lines. The basketball goal 14, mounted in the adjustable mounting system 10 is shown attached to the basketball goal back-board 12.

Figure 2:
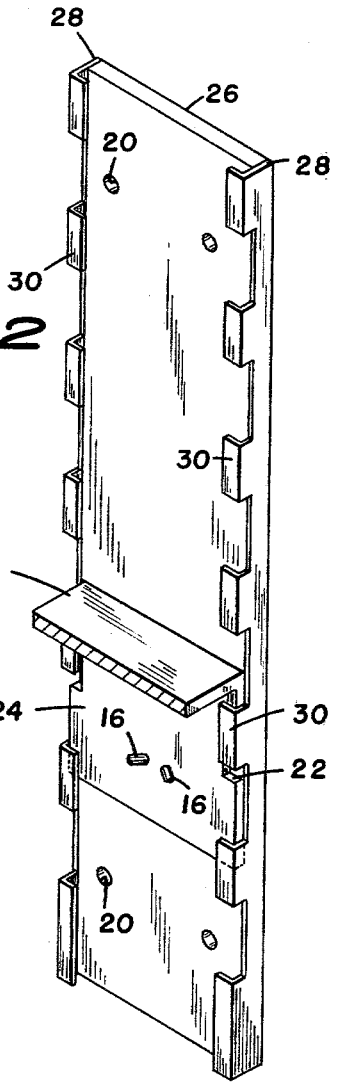
FIG. 2 is a perspective view of the adjustable mounting system shown in FIG. 1.
Figure 3:
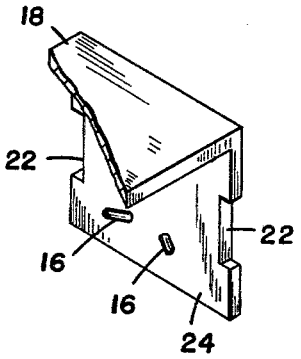
FIG. 3 is a perspective view of a modified basketball goal bracket for use with the embodiment shown in FIGS. 1 and 2.

The detail of the adjustable mounting is shown in FIGS. 2 and 3. The main mounting plate 26 of the system 10 has an angle flange 28 on each side attached to the plate 26 by suitable means (screws, pins, welding, or a similar method). The plate 26 and angle flanges 28 may be made as an integral unit and it is to be understood that such a construction is within the scope and intent of the invention.

A plurality of holes 20 are provided in the plate 26 for mounting that part of the system 10 to the back-board 12 with screws, nails, bolts, or a similar method.

The angle flange 28 on each side of plate 26 is cut out or notched out, leaving the lips 30 along each angle flange 28. The lips 30 are equal and similar in length and are in pairs, directly opposite each other, thereby making the notches also equal and similar in length and also in pairs directly opposite each other.

The back 24 part of the bracket 18 is modified for the first embodiment by cutting a notch 22 in each side of the back 24 of the bracket 18. The length of the notches 22 matches the length of the lips 30. The remaining unnotched part on each side of the back 24 of bracket 18 is divided into a "top" and "bottom" part as can be seen in FIG. 3.

The length of the "top" part, including the thickness of the horizontal flange of the bracket 18, and the "bottom" part of the remaining unnotched side of the back 24, must be such that they both will simultaneously pass into the notches in the angle flanges 28. Note that the width of the back 24 of bracket 18 is of a width that fits into the clear space or distance between the angle flanges 28 on each side of plate 26.

As the back 24 of bracket 18 then drops down in the clear space between angle flange 28 the top horizontal flange of bracket 18 will come to rest on one pair of lips 30. The back 24 will extend down behind the next lower pair of lips 30. Thus, the mounting bracket 18, with basketball hoop and net attached is held rigidly in place at the selected height.

As can be seen in FIG. 2, a plurality of adjustments is available for use for all sizes of players. It is to be understood that there is no specified limit as to how many adjustable positions the system 10 should have. The entire range is within the scope and intent of the invention.

Figure 5:
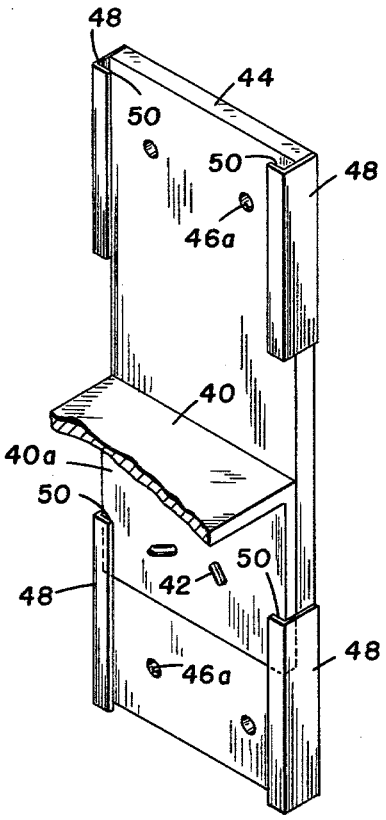
FIG. 5 is a perspective view of the adjustable mounting system shown in FIG. 4.

In a like manner, the second embodiment, FIGS. 4 and 5, is operated, except that no notches are cut out along the sides of the mounting bracket 40. Note that the back 40-*a* of bracket 40 is not modified. This system is useful where there is a limited number of heights to which it is desired to adjust the goal 36.

In FIGS. 4 and 5, the braces 42 are similar to the aforementioned braces 16, the net 38 is shown in phantom for the goal 36. The plate 44, having angle flanges 48 are attached in the same manner as aforementioned for the first embodiment.

In a like manner to the first embodiment, fastening means 46 through holes 46-*a* are used to fasten the plate 44 to the back-board 34.

A primary difference of this second embodiment in comparison with the first embodiment is that no modification is made to the back 40-*a* of bracket 40, it is used as manufactured. The width of the bracket 40 must fit inside the clear distance between the angle flanges 48 on plate 40.

Note that only two positions are shown for the second embodiment. This is not to preclude more positions and such a variation is within the scope and intent of the invention.

When bracket 40 is mounted in the adjustable mounting bracket 32 the height of the back 40-*a*, including the horizontal flange of bracket 40, must fit in the space between the upper and lower angle flanges 48 shown on plate 44 in FIG. 5.

Note that a variation of the angle flanges 48 has been shown (two short pieces). This is not to preclude the cut out method for the second embodiment as shown in the first embodiment, or to preclude the method shown in FIG. 5 being used for the first embodiment. These variations are within the scope and intent of this invention.

When the back 40-*a* of bracket 40 drops down in back of angle flanges 48, the horizontal flange of bracket 40 will rest on the top of the pair of lips 50.

As can be readily understood from the foregoing description of the invention, the present structure can be configured in different modes to provide an adjustable mounting for a basketball goal.

Accordingly, modifications and variations to which the invention is susceptible may be practiced without departing from the scope of the appended claims.

What is claimed is:

1. An adjustable system for mounting a basketball goal, comprising:

an adjustable holding means for holding a basketball goal, said adjustable holding means consisting of a plate and a pair of angle flanges, said angle flanges being located one on each side of said plate, a plurality of pairs of notched openings being formed in said pair of angle flanges to provide a plurality of pairs of inwardly directed angle flange lips, said adjustable holding means being attachable to a basketball back-board, and a bracket, said bracket being comprised of a normally horizontal portion and a downwardly directed normally vertical portion at a right angle thereto, said portions being so sized that the vertical portion slidably fits behind any pair of flange lips with the horizontal portion resting on the top edges thereof, and a pair of notches in said bracket of greater extent than the length of any flange lip cut into the sides of said vertical portion, said bracket being mounted in any selected position in said adjustable holding means, whereby said basketball goal can be connected to said bracket.

2. An adjustable system for mounting a basketball goal as recited in claim 1, wherein said plurality of pairs of angle flange lips are formed integral with said plate.

3. An adjustable system for mounting a basketball goal as recited in claim 1, wherein said plurality of pairs of angle flange lips are attached to said plate.

4. An adjustable system for mounting a basketball goal as recited in claim 1, wherein said plurality of pairs of angle flange lips are spaced apart by said notched openings.

* * * * *